US006935921B1

(12) United States Patent
Eudenbach et al.

(10) Patent No.: US 6,935,921 B1
(45) Date of Patent: Aug. 30, 2005

(54) PROSTHETIC BRASSIERE

(76) Inventors: Kimberly Eudenbach, 34 Maple St., Stoneham, MA (US) 02180; Sandra L. Busook, 5 Old Mill La., Reading, MA (US) 01867

( * ) Notice: Subject to any disclaimer, the term of this patent is extended or adjusted under 35 U.S.C. 154(b) by 0 days.

(21) Appl. No.: 10/797,353

(22) Filed: Mar. 10, 2004

(51) Int. Cl.[7] ..... A41C 3/00
(52) U.S. Cl. ..... 450/54; 450/58
(58) Field of Search ..... 450/1, 36–38, 450/54–58, 63, 70–74, 77–80, 82, 86, 88; 2/912, 913, 69, 73–75, 90, 96, 102–106, 2/109, 110, 113, 114, 118, 119, 122, 129, 2/133, 67

(56) References Cited

U.S. PATENT DOCUMENTS

| | | | | | |
|---|---|---|---|---|---|
| 3,040,750 | A | * | 6/1962 | Hurwitz | 450/58 |
| 3,064,265 | A | * | 11/1962 | Bridgewaters | 2/74 |
| 3,311,112 | A | * | 3/1967 | Murray | 450/1 |
| 3,826,266 | A | * | 7/1974 | Alpert | 450/11 |
| 3,950,792 | A | * | 4/1976 | Williams | 623/7 |
| 4,024,876 | A | * | 5/1977 | Penrock | 450/48 |
| 4,369,792 | A | | 1/1983 | Miller | |
| 4,637,398 | A | | 1/1987 | Sherwood | |
| 4,640,287 | A | * | 2/1987 | Anderson et al. | 450/36 |
| 4,699,144 | A | * | 10/1987 | Sherwood | 450/54 |
| 4,955,846 | A | * | 9/1990 | Greenberg | 450/69 |
| 5,634,245 | A | * | 6/1997 | Rouser et al. | 24/452 |
| 6,048,252 | A | | 4/2000 | Sebring | |
| 6,234,867 | B1 | | 5/2001 | Fanelli | |
| D466,673 | S | | 12/2002 | Furlong | |

* cited by examiner

*Primary Examiner*—Gloria M. Hale
(74) *Attorney, Agent, or Firm*—O'Connell Law Firm

(57) ABSTRACT

A prosthetic brassiere with first and second brassiere cups for retaining a prosthetic breast relative to the first cup, the second cup, or both cups. At least one back strap can traverse from outboard sides of the brassiere cups to form a body-encircling portion by use of a front-closure or rear-closure fastening arrangement. The fastening arrangement can have first and second jaw panels, a tongue panel, and hook and loop material for selectively retaining the first and second jaw panels relative to the tongue panel. The brassiere can have removable shoulder straps enabling conversion between strapped and strapless configurations. The shoulder straps can be coupled to the brassiere cups by retaining flaps that can be tucked into open inner volumes in the brassiere cups when the brassiere is in a strapless configuration. A privacy panel can be fixedly or removably retained relative to the brassiere cups traversing between upper portions thereof.

24 Claims, 7 Drawing Sheets

PROSTHETIC BRASSIERE

FIELD OF THE INVENTION

The present invention relates generally to brassieres. More particularly, this patent discloses and protects a prosthetic brassiere designed to enable a woman having experienced a mastectomy to dress, appear, feel, and behave in a truly feminine manner that is, to the greatest extent possible, imperceptibly different than would be the case had the mastectomy never occurred.

BACKGROUND OF THE INVENTION

The prior art has disclosed a plurality of brassiere structures with the stated goal of enabling women who have undergone mastectomy operations to again realize their pre-mastectomy appearance. Nonetheless, women who have had mastectomies have been relegated to the status of wearing what are essentially medical devices while their counterparts who have not experienced mastectomies enjoy a nearly infinite range of choices of brassiere styles, types, and colors. Prosthetic brassieres have demonstrated themselves to be overbuilt, harness-like structures that are heavy, bulky, and less than feminine. Being primarily utilitarian in nature, they have proven notoriously uncomfortable and aesthetically displeasing.

Under the present state of the art, it can be said that a woman seeking to purchase a mastectomy brassiere can have any brassiere style or color that she wants, provided it is the same as the one or two colors or styles carried by the supplier. Indeed, many a woman seeking a prosthetic brassiere has been met with the ability to select only between first and second models, both equally matronly in appearance and feel. Similarly, prosthetic brassieres of the prior art have commonly been limited to a single color or just two colors, such as black and white.

Furthermore, prosthetic brassieres of the prior art have often left the wearer with insufficient privacy in that many prior art prosthetic brassieres can separate from the chest wall of the wearer during certain movements, such as when the woman bends or twists. When such a separation occurs, scars deriving from pectoral incisions can be exposed and the partial or complete removal of the breast can be perceived. As one will readily appreciate, such an exposure can be embarrassing and can substantially eviscerate the basic purpose of the prosthetic brassiere.

Even further, many previously-disclosed prosthetic brassieres have proven to be difficult to manipulate physically, particularly for those who have recently undergone a mastectomy. Many brassieres require the manipulation of multiple complex fasteners. Other brassieres additionally or alternatively dispose the brassiere closure to the rear of the brassiere thereby further exacerbating the difficulty of operation for a woman having undergone mastectomy surgery.

As a result of these and further disadvantages demonstrated by the prior art, women who have undergone mastectomies have not only been severely limited in the brassieres available to them, but they have also effectively been foreclosed from wearing entire classes and types of garments. For example, those having experienced a mastectomy commonly have been unable to wear garments with low necklines. Furthermore, they have found it awkward, impossible, or at least aesthetically less than ideal to wear highly feminine garments. In any case, it has been the unfortunate state of the art that women who have experienced a mastectomy have for the most part been segregated into wearing entirely different classes of undergarments and clothing and, as a result, have been left, at least in certain respects, to feel and behave different from women who have not undergone such an operation.

Like substantially all Americans, the present inventors believe that an integral part of the American Dream is the freedom to choose, including in relation to the style of one's dress. However, as one would expect in light of the above-described state of the art, after personally experiencing a mastectomy, it was found that very little choice presently exists for a woman having undergone a mastectomy. Indeed, a woman will commonly find there to be just a few white brassiere styles, one style in black, and all options decidedly matronly. While facing the prospect of being forced to wear one of these supposed choices, a woman will quickly come to the stark realization that many of the clothes in her closet are no longer wearable. Strapless, scooped neck, spaghetti strapped, and similarly feminine garments are rendered off limits under the present state of the art. Indeed, in response to one of the inventor's question as to whether there was anything else available, a store clerk simply noted that the inventor was alive, as though that entirely justified the substantially complete loss of choice. That response and the resulting perception that an entire group of women no longer mattered made painfully clear to the inventors that there was a clear need for the design and creation of a comfortable, feminine variety of mastectomy brassieres.

SUMMARY OF THE INVENTION

Advantageously, the present invention is founded on the most broadly stated object of providing a brassiere that minimizes, and ideally eliminates, the line of demarcation between prosthetic brassieres and conventional brassieres to enable a woman having experienced a mastectomy to dress, appear, feel, and behave as though the mastectomy operation had never occurred.

A related object of the invention is to provide a prosthetic brassiere that is truly feminine in construction, appearance, and feel.

Another related object of the invention is to provide a prosthetic brassiere that can enable a woman to retain a prosthesis in a comfortable, yet stable, manner.

A further object of embodiments of the invention is to provide a prosthetic brassiere that can ensure privacy relative to a woman's chest area, including during bending, twisting, and the like, to prevent the exposure of chest scars and other traces of mastectomy operations.

Still another object of the invention is to provide a prosthetic brassiere that allows the wearer to wear substantially any type of clothing, including form fitting clothing and the like.

An even further object of embodiments of the invention is to provide a prosthetic brassiere that can be easily and comfortably applied, adjusted, and removed by the wearer.

A still further object of particular embodiments of the invention is to provide a prosthetic brassiere that can convert between a strapped arrangement and a strapless arrangement.

These, and in all likelihood further, objects and advantages of the present invention will become obvious not only to one who reviews the present specification and drawings but also to those who make use of an embodiment of the prosthetic brassiere disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth these objects, one basic embodiment of the invention comprises a brassiere for retaining at least one breast prosthesis relative to a chest of a wearer. The prosthetic brassiere can be founded on first and second brassiere cups, each with an inboard side, an outboard side, and a cup shell with an exterior surface and an interior surface that defines an open inner volume. The inboard sides of the first and second brassiere cups can be fixed together or selectively coupled by a front-closure fastening arrangement operably associated with the inboard sides of the brassiere cups. The brassiere can have a unitary back strap with a first end coupled to the outboard side of the first brassiere cup and a second end coupled to the outboard side of the second brassiere cup. Alternatively, the brassiere can have a rear-closure fastening arrangement for selectively coupling distal ends of first and second back strap segments. In any case, the fastening arrangement can form the first and second brassiere cups and the at least one back strap into a body-encircling portion for surrounding the chest of the wearer. A prosthetic breast can be selectively retained relative to the open inner volume of the first brassiere cup, the second brassiere cup, or both brassiere cups.

In certain embodiments, the fastening arrangement can take the form of first and second jaw panels, each with an inside face and an outside face, and a tongue panel with a first face and a second face in combination with means for selectively engaging the inside faces of the first and second jaw panels with the first and second faces of the tongue panel. The means for selectively engaging the inside faces of the first and second jaw panels with the first and second faces of the tongue panel can comprise corresponding sections of hook and loop material disposed on the inside faces of the first and second jaw panels and the first and second faces of the tongue panel. When so formed, the fastening arrangement can complete the body-encircling portion by an interposition of the tongue panel between the first and second jaw panels to cause the corresponding sections of hook and loop material to engage one another. Furthermore, the fastening arrangement can be readily disengaged by separating, as by peeling, the first and second jaw panels from the tongue panel.

In other embodiments, the fastening arrangement, which can be a front-closure fastening arrangement or a rear-closure fastening arrangement, can be formed by a plurality of hooks retained relative to the inboard side of the first brassiere cup in combination with a plurality of receiving loops retained relative to the inboard side of the second brassiere cup. The hooks can be selectively engaged relative to the receiving loops to form the body-encircling portion. To ensure that the plurality of hooks do not cause discomfort to the wearer, the hooks can be retained to an exterior surface side of the cup shell of the first brassiere cup and the receiving loops can be retained to an interior surface side of the cup shell of the second brassiere cup. Where necessary or desirable, a flap can be retained relative to an exterior surface side of the cup shell of the second brassiere cup for overlying and concealing the plurality of hooks and the plurality of receiving loops.

The prosthetic brassiere can include first and second shoulder straps that can be fixedly or removably and replaceably retained relative to the first and second brassiere cups and the at least one back strap. Where the shoulder straps are removably and replaceably retained, the prosthetic brassiere can be worn in a strapped arrangement or in a strapless configuration. In certain embodiments, the means for removably and replaceably coupling the first ends of the first and second shoulder straps to the first and second brassiere cups can be founded on retaining flaps, each with a proximal end coupled to the respective brassiere cup and a free distal end.

The first and second brassiere cups can each have a pocket disposed to an interior surface side of the cup shell adjacent to the retaining flap. Each pocket can have an aperture defining an entrance thereto such that the retaining flaps can be passed at least partially through the apertures and tucked at least partially into the pockets when the prosthetic brassiere is to be worn in a strapless configuration. With that, the retaining flaps can be at least partially retained and concealed by the pockets thereby improving the appearance and wearability of the prosthetic brassiere. Of course, by being disposed to an interior surface side of the cup shells, the pockets themselves will normally be concealed from view when the prosthetic brassiere is worn.

Under certain embodiments, the means for retaining the prosthetic breast relative to the open inner volume of the brassiere cup or cups can comprise a rear wall cooperating with the cup shell to substantially enclose the open inner volume of the brassiere cup. The aperture that defines the entrance to the aforedescribed pocket can simply comprise an opening between the cup shell and the rear wall. With that, a portion of the prosthetic breast can project at least partially through the aperture to maintain the breast prosthesis in a given orientation relative to the brassiere cup. Furthermore, the retaining flap can be tucked at least partially into the pocket overlying the projecting portion of the prosthetic breast thereby to conceal the prosthetic breast from view.

The rear wall of the brassiere cup can have a peripheral portion thereof formed as a flap to enable an insertion, removal, and adjustment of the prosthetic breast. The flap portion can be disposed to the outboard side of the brassiere cup so that the prosthetic breast can be accessed from the side of the brassiere. The peripheral flap portion can be selectively secured to a peripheral edge of the cup shell, such as by portions of hook and loop material or any other suitable means. Alternatively, the peripheral flap portion can be formed merely by a portion of the rear wall not being affixed to the cup shell thereby to provide an aperture. Under such a construction, the materials and the relative dimensions of the rear wall, the cup shell, and the aperture can be calibrated to enable an insertion of the breast prosthesis through the aperture but to cause the breast prosthesis to be retained in a fixed disposition once so inserted. In certain constructions, the cup shell of each of the first and second brassiere cups can have a volume of padding to ensure a consistently symmetrical appearance of the first brassiere cup relative to the second brassiere cup.

In certain embodiments, a privacy panel can traverse from an upper portion of the inboard side of the first brassiere cup to an upper portion of the inboard side of the second brassiere cup. The privacy panel can be fixed in place with an upper edge traversing from adjacent to an upper edge of the first brassiere cup to adjacent to an upper edge of the second brassiere cup. Alternatively, a means can be provided for enabling a removal and replacement of the privacy panel such that the prosthetic brassiere can be worn with or without the privacy panel and whereby multiple different privacy panels can be selectively retained relative to the prosthetic brassiere.

To correspond to the shape of the upper edges of the first and second brassiere cups, the privacy panel can have lower edges disposed in a generally V-shaped configuration. The means for enabling a removal and replacement of the privacy panel can comprise corresponding portions of hook and loop material. Under one configuration, portions of hook or loop material can be disposed on the outside face of the privacy panel and corresponding portions of loop or hoop material can be disposed to interior surface sides of the first and second brassiere cups. Under such an arrangement, the privacy panel can be retained relative to the first and second brassiere cups with a portion thereof underlying the first and second brassiere cups.

One will appreciate that the foregoing discussion broadly outlines the more important features of the invention to enable a better understanding of the detailed description that follows and to instill a better appreciation of the inventors' contribution to the art. Before any particular embodiment or aspect thereof is explained in detail, it must be made clear that the following details of construction, descriptions of hardware and software designs, and illustrations of inventive concepts are mere examples of the many possible manifestations of the invention.

DETAILED DESCRIPTION OF PREFERRED EMBODIMENTS

Figure 1:
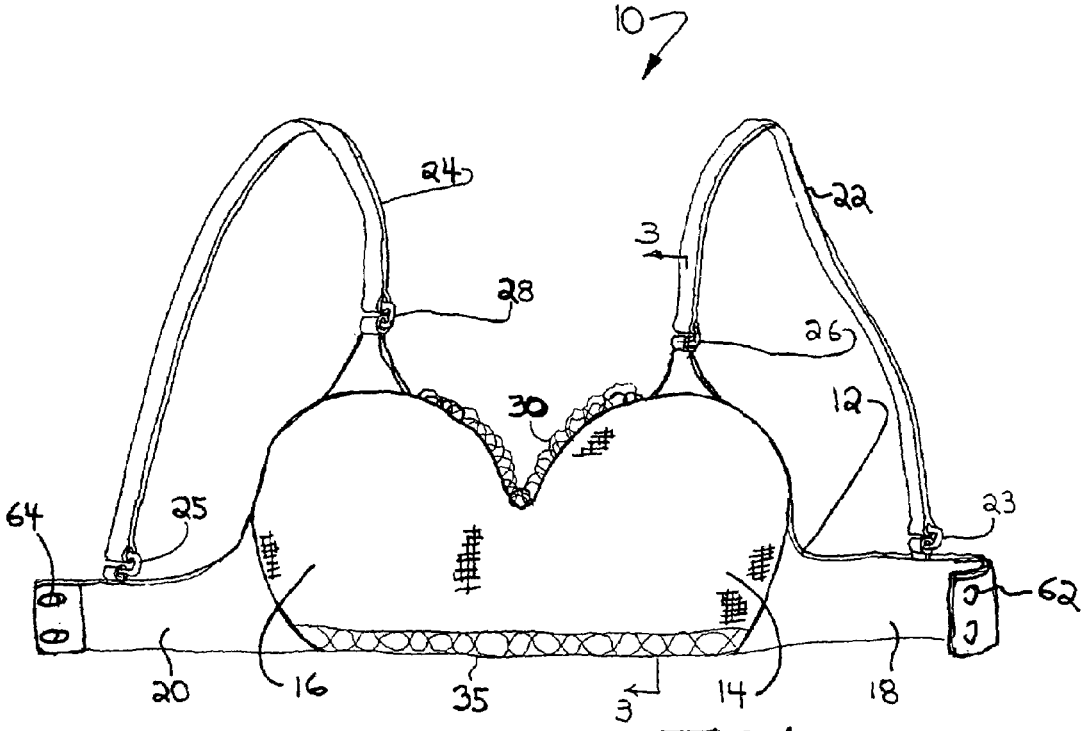
FIG. 1 is a view in front elevation of a prosthetic brassiere according to the present invention.

As is the case with many inventions, the present invention for a prosthetic brassiere is subject to a wide variety of embodiments. However, to assure that one skilled in the art will be able to understand and, in appropriate cases, practice the present invention, certain preferred embodiments and aspects of preferred embodiments of the broader invention revealed herein are described below and shown in accompanying figures.

Looking more particularly to the drawings, a first exemplary embodiment of the present invention for a prosthetic brassiere is indicated generally at 10 in FIGS. 1 through 4. There, the prosthetic brassiere 10 has a body-encircling portion 12 that is formed by a left cup 14 with an inboard side coupled to an inboard side of a right cup 16 in combination with a first strap segment 18 that extends from an outboard side of the left cup 14 and a second strap segment 20 that extends from an outboard side of the right cup 16.

Figure 5A:
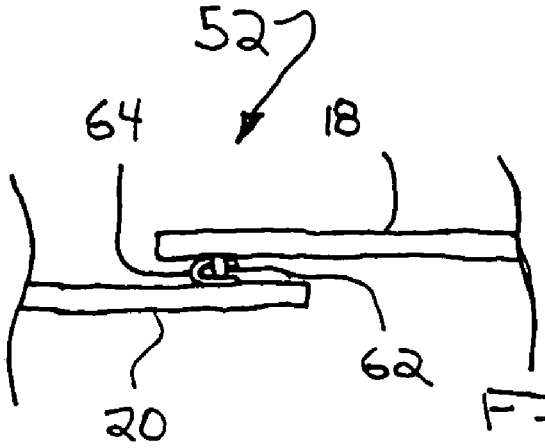
FIG. 5A is a top plan view of a rear closure fastening arrangement according to the present invention.

Each of the first and second strap segments 18 and 20 has a proximal end fixed to the cup 14 or 16 and a distal end incorporating a means for selectively coupling to the distal end of the other of the first and second strap segments 18 and 20 to form a rear-closure type fastening arrangement, which is indicated at 52 in FIG. 5A. By use of the selective coupling means, the first and second strap segments 18 and 20 and the left and right cups 14 and 16 can form the body encircling portion 12 into a loop for encircling the upper torso of a wearer. A band 35, which can be crafted of elastic material, can traverse the bases of the left and right cups 14 and 16. The band 35 stabilizes and supports the left and right cups 14 and 16 and the prosthetic brassiere 10 in general to prevent sliding and other inadvertent movement while ensuring the comfort of the wearer.

Lengths of lace material or the like can be applied to the prosthetic brassiere 10 to enhance its feminine feel and appearance. For example, as is shown in FIG. 1, lace strips 30 can be applied to all or part of the upper edges of the left and right cups 14 and 16. As one will appreciate, the lace strips 30 not only enhance the overall femininity of the prosthetic brassiere 10 but they also provide a concealing function relative to the chest of the wearer.

Figure 2:
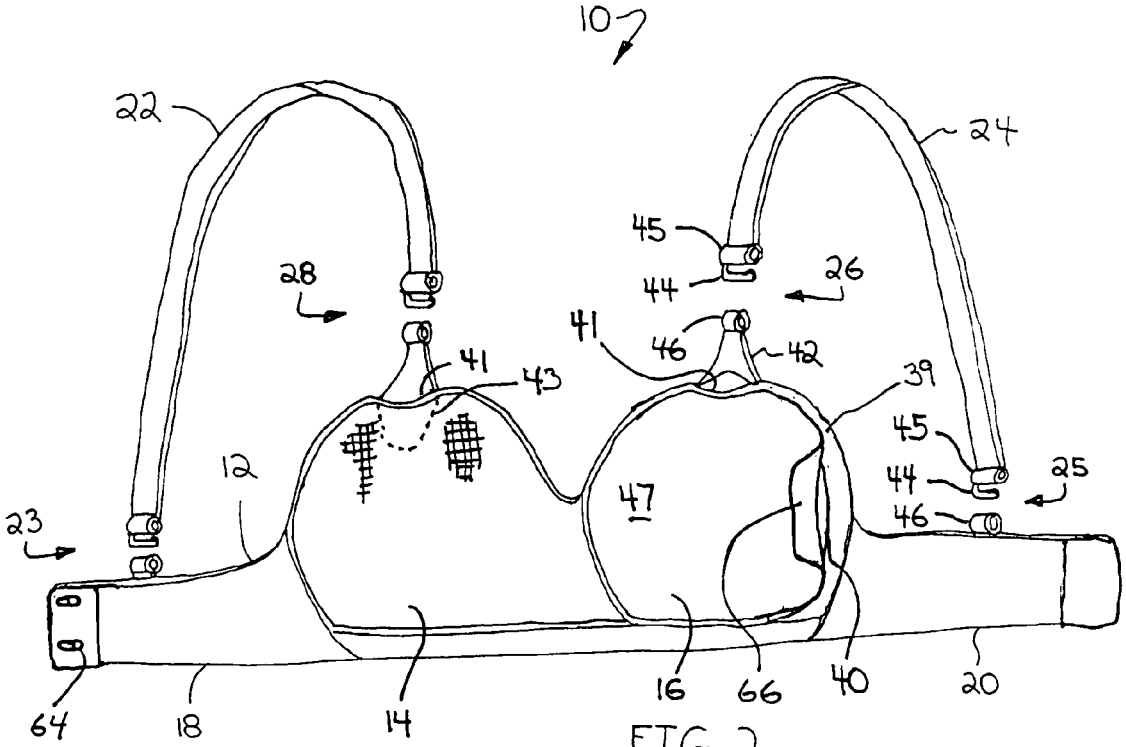
FIG. 2 is a view in rear elevation of the prosthetic brassiere of FIG. 1.

In FIG. 5A, one sees that the fastening arrangement 52, which in the embodiment of FIGS. 1 and 2 comprises a rear-closure type fastening arrangement 52, can comprise a plurality of hooks 64 applied to what can be considered the outer surface of the distal end of the first strap segment 18 in combination with a corresponding plurality of receiving loops 62 applied to what can be considered the inner surface of the distal end of the second strap segment 20. The first and second strap segments 18 and 20 can be joined to complete the body-encircling portion 12 by engaging the hooks 64 with the receiving loops 62, and the first and second strap segments 18 and 20 can be separated by a disengagement of the hooks 64 from the receiving loops 62. The number of hooks 64 and receiving loops 62 could vary within the scope of the invention. The illustrated example incorporates two hook 64 and receiving loop 62 combinations to ensure a secure connection of the left and right cups 14 and 16 without presenting undue difficulty to the wearer in engaging and disengaging the left and right cups 14 and 16, which has often been problematic for women having undergone a mastectomy under prior art structures where significantly greater numbers of fastening members have had to be manipulated.

A left shoulder strap 22 has a first end for coupling to the left cup 14 and a second end for coupling to a body portion of the first strap segment 18. Similarly, a right shoulder strap 24 has a first end for coupling to the right cup 16 and a second end for coupling to a body portion of the second strap segment 20. When the first and second ends of the left and right shoulder straps 22 and 24 are so coupled, the left and right shoulder straps 22 and 24 can be caused to overlie the left and right shoulders of a wearer. As such, the left and right shoulder straps 22 and 24 can be employed to provide added support to the prosthetic brassiere 10 and, derivatively, one or more breast prostheses, indicated at 40 in FIGS. 2 through 4, and, if one remains, a natural breast of the wearer. The left and right shoulder straps 22 and 24 can be formed from a wide variety of materials and can be fixed in length, adjustable in length, or resiliently stretchable. The straps 22 and 24 can be formed from opaque material. In certain alternative embodiments, the left and right straps 22 and 24 can be formed entirely or in part from a translucent or transparent material.

In the present embodiment of the prosthetic brassiere 10, the left and right shoulder straps 22 and 24 are coupled to the left and right cups 14 and 16 and the first and second strap segments 18 and 20 by means for removably and replaceably coupling the left and right straps 22 and 24 to the cups 14 and 16 and the strap segments 18 and 20. The removable and replaceable coupling means could take many forms that would be readily obvious based on this disclosure. Each such means would be well within the scope of the present invention.

In the present figures, the removable and replaceable coupling means are generally indicated at 26 and 28. The removable and replaceable coupling means 26 and 28 at the respective first ends of the left and right straps 22 and 24 each comprises a hook arm 44 retained at the first end of the respective strap 22 or 24 by a loop 45 at the first end of the strap 22 or 24 in combination with a receiving loop 46 retained relative to the cup 14 or 16 at a distal end of a flexible strap retaining flap 42. Similarly, the removable and replaceable coupling means 23 and 25 at the second ends of each of the left and right straps 22 and 24 each comprises a hook arm 44 retained at the second end of the respective strap 22 or 24 by a loop 45 at the second end of the strap 22 or 24 in combination with a receiving loop 46 that is directly retained relative to the strap segment 18 or 20. Under this arrangement, the prosthetic brassiere 10 can be worn with the straps 22 and 24 attached to the cups 14 and 16 and the strap segments 18 and 20 as is shown in FIG. 1 such that the prosthetic brassiere 10 will act as a strapped brassiere. Alternatively, the straps 22 and 24 can be removed as shown, for example, in FIG. 2 by disengaging the hook arms 44 from each of the receiving loops 46 so that the prosthetic brassiere 10 can be worn in a strapless configuration.

When the straps 22 and 24 are removed to enable the prosthetic brassiere 10 to be worn as a strapless brassiere, the wearer can enjoy the benefits attended thereto that have been in large part unavailable to women who have undergone mastectomies. For example, when wearing the prosthetic brassiere 10 in a strapless configuration, a woman can wear strapless dresses, tops, and other clothing as well as clothing with narrow straps that would likely leave brassiere straps at least partially exposed. Furthermore, a woman wearing the prosthetic brassiere 10 in a strapless configuration can wear sheer clothing without visible brassiere straps, which might be impossible for the woman who has experienced a mastectomy who would otherwise be required to choose from the very limited brassiere constructions available under the prior art.

It will be appreciated, of course, that a basic purpose of the prosthetic brassiere 10 is to retain and support at least one prosthetic breast 40 relative to the chest of a wearer in a manner that simulates the appearance, feel, and other characteristics of a natural breast to the greatest extent possible thereby to enable the wearer to dress, move, and otherwise act as though neither breast had been subject to a mastectomy excision procedure. In certain embodiments, therefore, the prosthetic brassiere 10 may be constructed to retain a prosthetic breast 40 relative to both the left and right cups 14 and 16, relative to the left cup 14 only while the right cup 16 is adapted to receive a natural right breast, or relative to the right cup 16 only while the left cup 14 is adapted to receive a natural left breast as is depicted in the example of FIG. 2. Each such embodiment is within the scope of the present invention.

Figure 3:
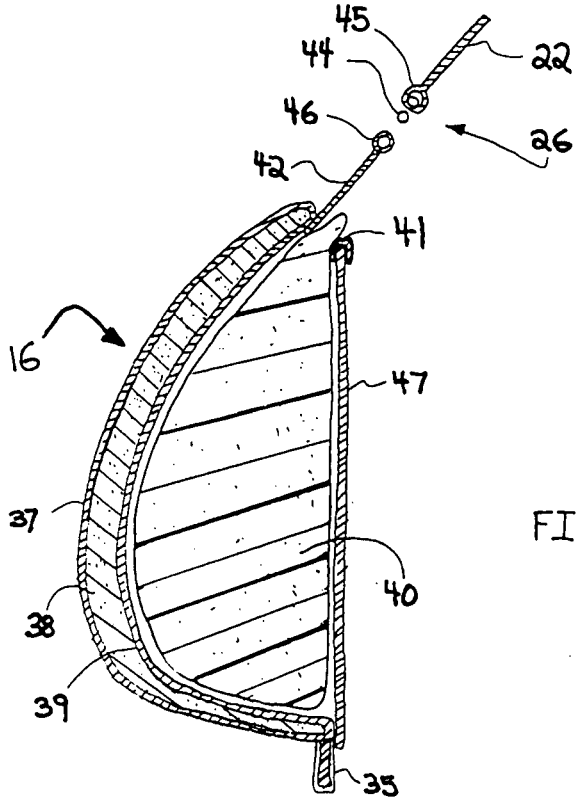
FIG. 3 is a cross sectional view of the prosthetic brassiere of FIG. 1 taken along the line 3—3 in FIG. 1 in a strapped configuration.
Figure 4:
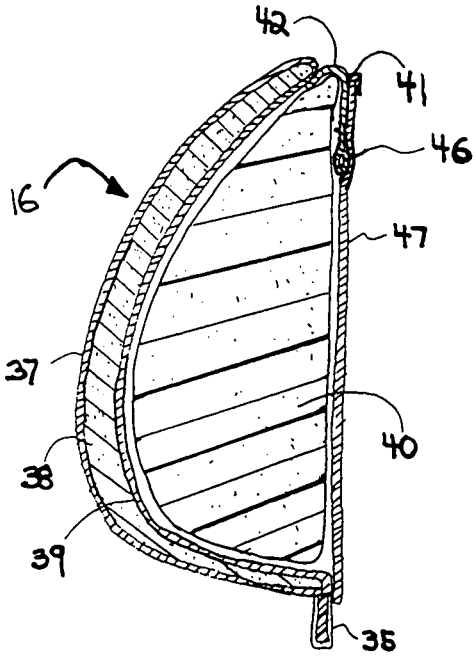
FIG. 4 is a cross sectional view of the prosthetic brassiere of FIG. 1 in a strapless configuration.

The right cup 16 arrangement is shown in cross sectional views in FIGS. 3 and 4. There, one sees that the breast prosthesis 40 is retained within a substantially enclosed open inner volume. The prosthetic brassiere 10 is by no means limited by the type, structure, or size of the breast prosthesis 40 retained thereby. As such, a wearer could choose to retain lightweight, dense, liquid, foam, and any other type of breast prosthesis 40 within the open inner volume. The open inner volume is defined at a rearward periphery by a rear wall 47 of flexible material and at a frontal periphery by an inner wall 39 of a cup shell. The cup shell has an outer wall 37 that is separated over a portion or over its entire body portion from the inner wall 39 with the volume interposed therebetween being occupied with a volume of light padding 38.

It will be noted that a natural breast can, under certain circumstances, demonstrate an erection of the mammary papilla or the nipple. Where such an event occurs in a woman having experienced a mastectomy with evidence of that occurrence being externally visible, one will appreciate that there will be an inherently anti-symmetrical appearance of the brassiere cup supporting the natural breast as compared to the brassiere cup supporting the breast prosthesis 40. Such an anti-symmetrical appearance can operate as telltale evidence of a mastectomy operation and, as such, can be particularly embarrassing to the wearer.

Advantageously, with the provision of the light padding 38 between the outer and inner walls 37 and 39, the present embodiment of the prosthetic brassiere 10 ensures a symmetrical appearance of the right cup 16, which in this case is adapted for retaining a breast prosthesis 40, relative to the left cup 14, which in this case is adapted for receiving a natural breast of the wearer. More particularly, the light padding 38 will operate to conceal any erection of the mammary papilla in the natural breast to prevent the left cup 14 from becoming distinguishable from the right cup 16, which retains the breast prosthesis 40, in this respect.

The rear wall 47, the inner wall 39, and the outer wall 37 can be formed from substantially any appropriate material, which will, of course, preferably be comfortable, flexible, pliable, and, possibly, stretchable. Where a cup 14 or 16 is to receive a natural breast, such as is the left cup 14 in this embodiment, it can be of substantially the same construction as the right cup 16 depicted in FIGS. 3 and 4 except that the rear wall 47 will be foregone to enable the reception of the wearer's natural breast into the open inner volume.

As FIG. 2 shows, the rear wall 47 of the cup 16 can have a flap portion 66 at the outboard edge thereof to provide an aperture to enable access to and the insertion and removal of the breast prosthesis 40. The flap portion 66 can be operable in any effective manner. The flap portion could incorporate or be associated with a means for selectively providing access to and closing off the open inner volume of the cup 14 or 16. For example, the prosthetic brassiere 10 could incorporate a means, such as hook and loop material, buttons, snaps, or any other effective means, for selectively securing the peripheral edge of the flap portion 66 relative to the peripheral edge of the inner wall 39 of the brassiere cup 16. In the depicted embodiment, however, the flap 66 is simply formed by having a portion of the rear wall 47 not affixed to the inner wall 39 of the brassiere cup 16 to create an aperture in communication with the open inner volume. The ability to insert the breast prosthesis 40 into the open inner volume and to have it retained therein can be achieved by proper material selection, by proper dimensioning of the aperture in relation to the breast prosthesis 40, and/or, as will be described in greater detail below, by a retention of a tip portion of the breast prosthesis 40.

By combined reference to FIGS. 2 through 4, it can be perceived that an aperture 41 is provided in an upper central portion of each of the left and right cups 14 and 16. Relative to the cup or cups that is or are adapted to retain a breast prosthesis 40, which in this example comprises only the right cup 16, the aperture 41 is disposed between upper central portions of the rear wall 47 and the cup shell inner wall 39. With such an aperture 41 provided, a breast prosthesis 40 with a tip portion, as is commonly the case, can be disposed in the open inner volume of the cup 16 with the tip portion projecting at least partially through the aperture 41. With that, the aperture 41 and the tip portion can cooperate to maintain the orientation of the breast prosthesis 40 relative to the cup 16.

One will again note that the prosthetic brassiere 10 can be converted for use as a strapless brassiere by a disengaging of each of the hook arms 44 from each of the receiving loops 46 thereby to enable a removal of the straps 22 and 24. When the straps 22 and 24 are so removed, the retaining flaps 42 and the receiving loops 46 will initially be loose relative to the remainder of the prosthetic brassiere 10, which could be disadvantageous in appearance, comfort, and overall wearability of the prosthetic brassiere 10. Advantageously, however, with the provision of the aperture 41 into the open inner volume of the right cup 16, a pocket is effectively formed by the open inner volume of the cup 16 with the aperture 41 being the entrance thereto. However, where a brassiere cup is adapted to retain a natural breast as is the case relative to the left cup 14 in FIG. 2 and where the cup 14, therefore, does not have a rear wall 47, a small pocket 43 or other effective arrangement providing an open inner volume for acting as a receiving volume or area can be provided in the upper portion of the brassiere cup 14 with the aperture 41 again comprising the entrance thereto. With this, the receiving loops 46 and at least a portion of the retaining flaps 42 can be concealed by being tucked through the apertures 41 and, therefore, into the open inner volume of the cup 16 or into the pocket 43 as the case may be.

Of course, it will be appreciated that, while the receiving loop 46 and retaining flap 42 are depicted as being tucked in rearward of the breast prosthesis 40 in FIG. 4, the receiving loop 46 and retaining flap 42 could alternatively be tucked in forward of the breast prosthesis 40 within the open inner volume. In either case, relative to both brassiere cups 14 and 16, the receiving loops 46 and the retaining flaps 42 can be neatly tucked away to eliminate any discomfort, loss of wearability, or objectionable appearance. However, one will appreciate that tucking in the receiving loop 46 and the retaining flap 42 rearward of a breast prosthesis 40 produces the advantageous result of having the retaining flap 42 overlie the protruding tip portion of the breast prosthesis 40 thereby to shield and conceal the tip portion of the breast prosthesis 40. Furthermore, where the receiving loops 46 and the retaining flaps 42 are made from a relatively thin, flexible material, their being interposed between the breast prosthesis 40 and the rear wall 47 or the inner wall 39 of the cup shell will be substantially imperceptible in feel and appearance.

Figure 6:
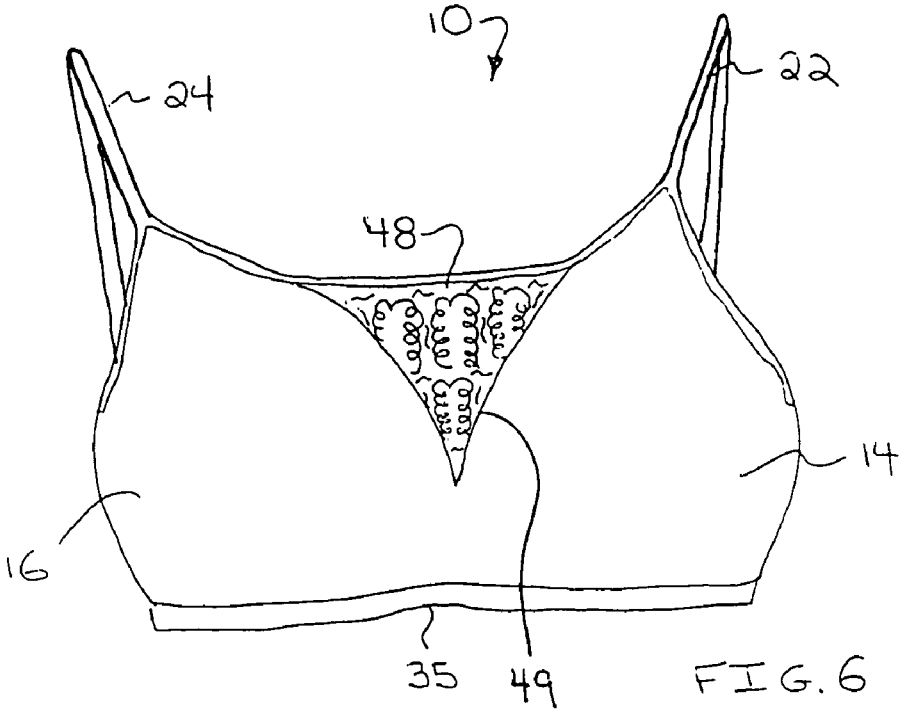
FIG. 6 is a view in front elevation of an alternative embodiment of a prosthetic brassiere pursuant to the present invention.

An alternative embodiment of the prosthetic brassiere 10 is depicted in FIG. 6. There, the left and right straps 22 and 24 are not removable. Instead, the ends of the straps 22 and 24 are affixed directly to the left and right cups 14 and 16 and the first and second strap segments 18 and 20. As such, the prosthetic brassiere 10 is designed to function as a strapped brassiere only and not as a strapless brassiere. The left and right straps 22 and 24 again can be formed from a wide variety of materials including opaque materials, translucent or transparent materials, or any combination thereof.

The straps 22 and 24 can incorporate an adjusting means, such as a buckle arrangement or the like, for enabling the effective lengths of the straps 22 and 24 to be adjusted when necessary. Alternatively, the straps 22 and 24 can comprise resilient strips of material such that they can stretch and contract to accommodate the wearer and to ensure and maintain close contact between the upper portions of the left and right cups 14 and 16 and the chest of the wearer. That close contact not only adds to the comfort of the prosthetic brassiere 10 but it also prevents inadvertent exposure of the breast prosthesis 40, any scarring that the wearer might have as a result of mastectomy surgery, and the remainder of the wearer's chest area that is intended to be covered by the left and right cups 14 and 16.

Bearing in mind that concealing the breast prosthesis 40, any scarring, and the central portion of the chest area are basic goals of a prosthetic brassiere, the embodiment of the prosthetic brassiere 10 of FIG. 6 additionally includes a privacy panel 48. The privacy panel 48 spans the gap that would otherwise exist in the V-shaped area between the downwardly trailing upper inside edges of the left and right cups 14 and 16 and is designed to lie flat against the chest of the wearer. In this embodiment, the privacy panel 48 comprises a panel of lace material. However, it could be formed to similar advantage from numerous other materials and with numerous other designs.

By way of example, the privacy panel 48 could be a solid opaque panel of material, a panel with apertures therein and/or designs or other materials applied thereto, or substantially any other arrangement. The privacy panel 48 could be formed from any natural or synthetic material or combination thereof and can be resilient or non-resilient. In any case, the privacy panel 48 can have an upper edge that traverses the gap that would otherwise be disposed between the cups 14 and 16 from adjacent to the upper edge of each of the cups 14 and 16. The privacy panel 48 advantageously can shield the area between the cups 14 and 16 and the area therebelow and adjacent thereto from view without detracting from, and possibly enhancing, the feminine appearance and feel of the prosthetic brassiere 10.

It will be appreciated, therefore, that the privacy panel 48 can provide a plurality of advantages to the wearer of the prosthetic brassiere 10. However, it may be worthwhile in certain embodiments to have the option of removing the privacy panel 48. By way of example, there may be circumstances where, notwithstanding the advantages derived therefrom, a woman would wish to wear the prosthetic brassiere 10 without the privacy panel 48. In other cases and embodiments, it may be still more advantageous to be able to remove a given privacy panel 48 and to replace it with a different privacy panel 48. For example, a wearer can switch between privacy panels 48 of different styles, colors, materials, and other characteristics to change the overall appearance of the prosthetic brassiere 10 and thereby to increase its overall wearability. One prosthetic brassiere 10, therefore, could effectively act and be worn as though it were multiple different brassieres.

Figure 7:
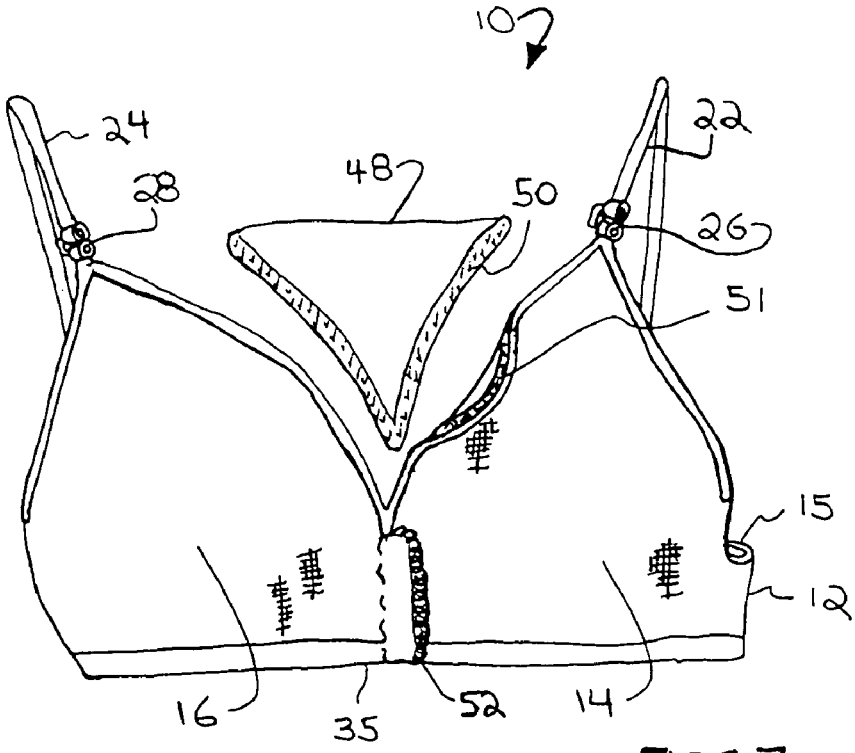
FIG. 7 is a view in front elevation of another alternative embodiment of a prosthetic brassiere according to the present invention.

FIG. 7 depicts an embodiment of the prosthetic brassiere 10 with a privacy panel 48 that can be removed and replaced. In this example, the privacy panel 48 is V shaped, but certainly other shapes and configurations are possible and within the scope of the invention. In the embodiment of FIG. 7, for example, the privacy panel 48 is rendered removable and replaceable by outwardly facing strips 50 of hook material disposed along the outer edges of the privacy panel 48 in combination with mating inwardly facing strips 51 of loop material disposed along the inner edges of the left and right cups 14 and 16. While the disposition of the strips 50 and 51 could well be reversed, the depicted configuration may be considered advantageous in that contact between the hooks of the strips 50 of hook material and the wearer's body would be prevented. It will be appreciated, of course, that numerous other means for providing a removable and replaceable privacy panel 48, including buttons, zippers, adhesives, clips, and other fasteners and retaining means, would be readily obvious to one of skill in the art after reviewing this disclosure.

The embodiment of FIG. 7 additionally varies from the previously described prosthetic brassieres 10 in that the body-encircling portion 12 is completed by a front-closure type fastening arrangement 52 as compared to the rear-closure type fastening arrangement 52 of, for example, FIG. 1. Two of the many possible constructions for the front-closure type fastening arrangement 52 are shown in the expanded views of FIGS. 5B, 8, and 9, in each case comprising a means for selectively securing the inboard edge of the left cup 14 to the inboard edge of the right cup 16. In each case, the first and second strap segments 18 and 20 are foregone in favor of a unitary strap 15 that couples the outboard edges of the left and right cups 14 and 16.

Figure 5B:
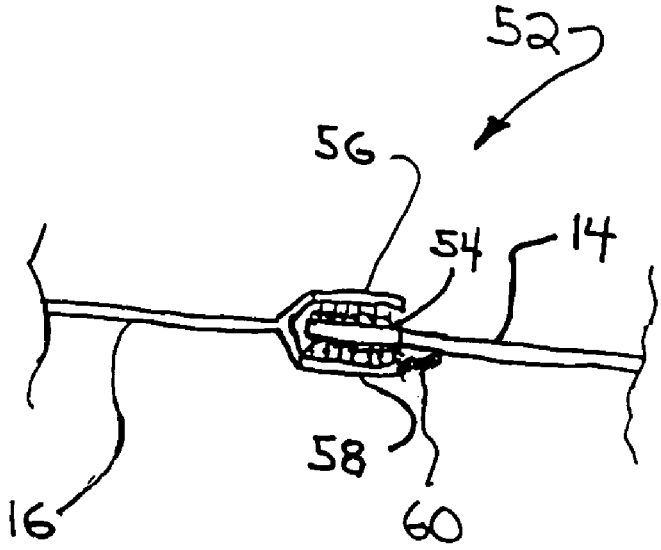
FIG. 5B is a top plan view of a front closure fastening arrangement according to the present invention.
Figure 8:
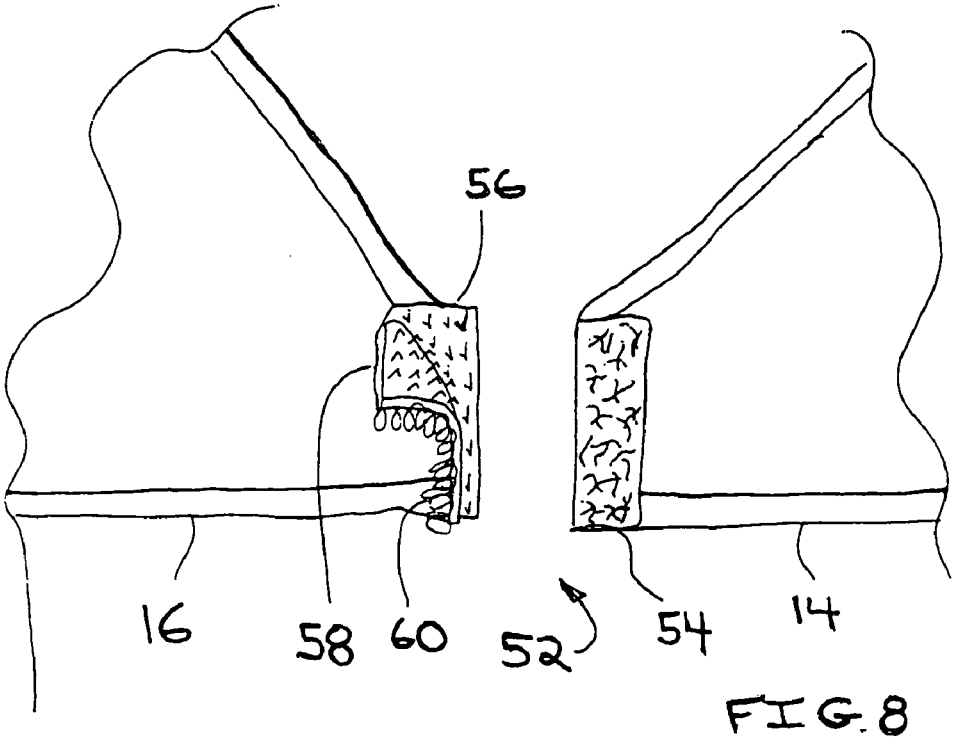
FIG. 8 is a view in front elevation of a front closure fastening arrangement under the present invention.

In FIGS. 5B and 8, the fastening arrangement 52 comprises first and second jaw panels 56 and 58 retained at the inboard edge of the right cup 16 in combination with a tongue panel 54 disposed at the inboard edge of the left cup 14. Areas of hook material are disposed on the inner faces of the first and second jaw panels 56 and 58 while areas of loop material are disposed on both faces of the tongue panel 54. Under this construction, the left and right cups 14 and 16 can be coupled to complete the body-encircling portion 12 by interposing the tongue panel 54 between the first and second jaw panels 56 and 58 causing the hook material to engage the loop material. The left and right cups 14 and 16 can be separated by peeling the first and second jaw panels 56 and 58 away from tongue panel 54. Trim 60 may be applied to the distal edge of the second jaw panel 58 for concealing the underlying hook and loop material and otherwise improving the appearance of the brassiere 10.

Figure 9:
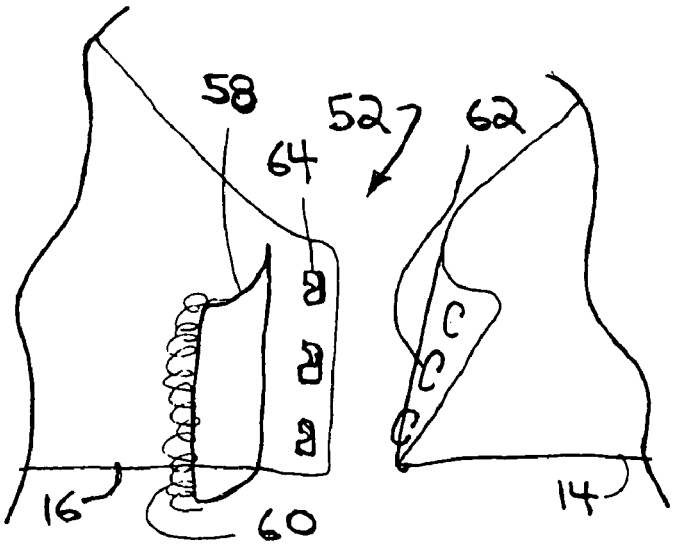
FIG. 9 is a view in front elevation of an alternative front closure fastening arrangement pursuant to the instant invention.

In FIG. 9, the fastening arrangement 52 comprises a plurality of hooks 64 applied to the outer surface of the right cup 16 adjacent to its inboard edge in combination with a corresponding plurality of receiving loops 62 applied to the inner surface of the left cup 14 adjacent to its inboard edge. The left and right cups 14 and 16 can be joined to complete the body-encircling portion 12 by engaging the hooks 64 with the receiving loops 62. The cups 14 and 16 can be separated by a disengagement of the hooks 64 and receiving loops 62. The number of hooks 64 and receiving loops 62 could vary within the scope of the invention. The present embodiment incorporates three hook 64 and receiving loop 62 combinations to ensure a secure connection of the left and right cups 14 and 16 without presenting undue difficulty to the wearer in engaging and disengaging the left and right cups 14 and 16. A flap 58 can be disposed on the outer surface of the right cup 16 to shield and conceal the hooks 64, the receiving loops 62, and the seam between the left and right cups 14 and 16. Trim 60 can be applied to the distal edge of the flap 58.

Figure 10:
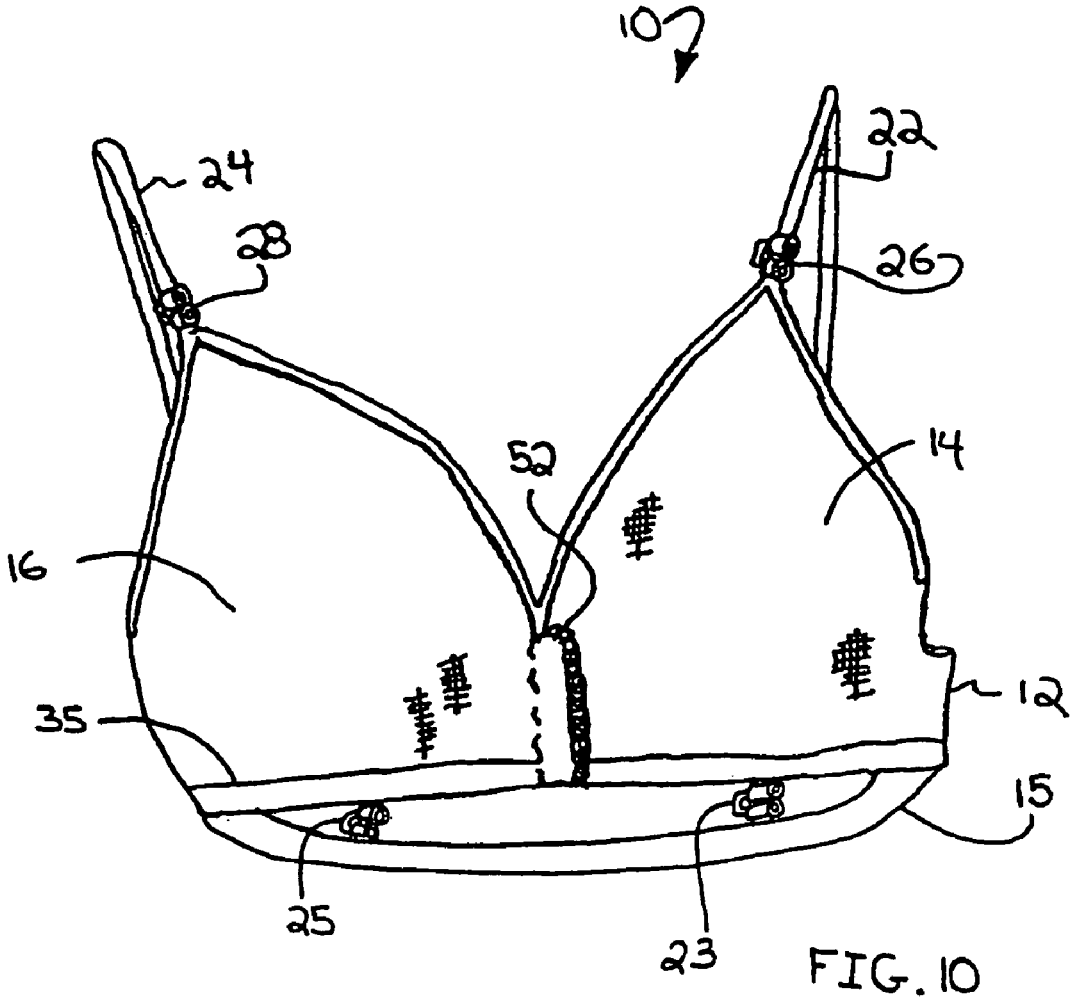
FIG. 10 is a view in front elevation of another embodiment of a prosthetic brassiere pursuant to the present invention.

FIG. 10 illustrates yet another embodiment of the prosthetic brassiere 10. The prosthetic brassiere 10 of FIG. 10 is similar in many respects to the embodiment of FIG. 7 except that the privacy panel 48 is foregone. As such, the prosthetic brassiere 10 of FIG. 10 has a left cup 14 that can be joined with a right cup 16 by a front closure fastening arrangement 52, and a unitary strap again couples the outboard edges of the left and right cups 14 and 16. The front closure fastening arrangement 52 can be of any appropriate type, including those explicitly described herein. The left and right straps 22 and 24 can be permanently attached or can be removable by virtue of removable and replaceable coupling means 23, 25, 26, and 28.

From the foregoing, it will be appreciated that prosthetic brassieres 10 according to the invention provide the wearer with a plurality of advantages over the arrangements of the prior art. Most basically, by providing a prosthetic brassiere 10 that is entirely feminine in appearance, construction, and feel, the present invention minimizes, and ideally erases, the previously definitive line of demarcation between prosthetic brassieres and conventional brassieres. By doing so, prosthetic brassieres 10 pursuant to the invention disclosed herein enable a woman who has undergone a mastectomy to dress, look, feel, and behave as though the mastectomy operation had never occurred.

Furthermore, embodiments of the prosthetic brassiere 10 can ensure privacy relative to a woman's chest area, including during bending, twisting, and the like, to prevent the exposure of chest scars and other traces of mastectomy operations by, for example, the provision of a privacy panel 48, which can be fixed in place or removable and replaceable. Still further, by providing straps 22 and 24 that can be removed, embodiments of the prosthetic brassiere 10 can be readily converted between strapped and strapless configurations. Also, by use of the fastening arrangements 52 disclosed herein, the prosthetic brassiere 10 can be conveniently applied, adjusted, and removed, including by wearer's with limited strength and mobility deriving from a mastectomy operation.

With a plurality of exemplary embodiments and details of the present invention for a prosthetic brassiere disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventors. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof.

What is claimed is:

1. A prosthetic brassiere for retaining at least one breast prosthesis relative to a chest of a wearer, the prosthetic brassiere comprising:

a first brassiere cup with an inboard side, an outboard side, and a cup shell with an exterior surface and an interior surface that defines an open inner volume;

a second brassiere cup with an inboard side, an outboard side, and a cup shell with an exterior surface and an interior surface that defines an open inner volume;

a means for coupling the inboard side of the first brassiere cup to the inboard side of the second brassiere cup;

at least one back strap with an end coupled to the outboard side of the first brassiere cup and an end coupled to the outboard side of the second brassiere cup;

a fastening arrangement operably associated with the first brassiere cup, the second brassiere cup, and the at least one back strap for enabling the first brassiere cup, the second brassiere cup, and the at least one back strap to cooperate to form a body-encircling portion for surrounding the chest of the wearer;

a means for retaining a prosthetic breast relative to the open inner volume of the first brassiere cup; and a privacy panel traversing from an upper portion of the inboard side of the first brassiere cup to an upper portion of the inboard side of the second brassiere cup.

2. The prosthetic brassiere of claim 1 wherein the fastening arrangement comprises a first jaw panel with an inside face and an outside face, a second jaw panel with an inside face and an outside face, and a tongue panel with a first face and a second face in combination with means for selectively engaging the inside faces of the first and second jaw panels with the first and second faces of the tongue panel.

3. The prosthetic brassiere of claim 2 wherein the means for selectively engaging the inside faces of the first and second jaw panels with the first and second faces of the tongue panel comprises corresponding sections of hook and loop material disposed on the inside faces of the first and second jaw panels and the first and second faces of the tongue panel.

4. The prosthetic brassiere of claim 2 wherein the fastening arrangement comprises a rear-closure fastening arrangement, wherein the at least one back strap comprises first and second strap segments, wherein the first strap segment has a proximal end coupled to the outboard side of the first or the second brassiere cup and a free distal end, wherein the second strap segment has a proximal end coupled to the outboard side of the other of the first or the second brassiere cup and a free distal end, wherein the first and second jaw panels are coupled to the distal end of the first strap segment, and wherein the tongue panel is coupled to the distal end of the second strap segment whereby the distal ends of the first and second strap segments can be coupled together by interposing the tongue panel between the first and second jaw panels to cause the corresponding sections of hook and loop material to engage and whereby the first and second strap segments can be separated by separating the first and second jaw panels from the tongue panel.

5. The prosthetic brassiere of claim 1 wherein the privacy panel has an upper edge traversing from adjacent to an upper edge of the first brassiere cup to adjacent to an upper edge of the second brassiere cup.

6. The prosthetic brassiere of claim 1 further comprising a means for enabling a removal and replacement of the privacy panel whereby the prosthetic brassiere can be worn with or without the privacy panel and whereby multiple different privacy panels can be selectively retained relative to the prosthetic brassiere.

7. The prosthetic brassiere of claim 6 wherein the privacy panel has lower edges disposed in a generally V-shaped configuration.

8. The prosthetic brassiere of claim 6 wherein the means for enabling a removal and replacement of the privacy panel comprises corresponding portions of hook and loop material.

9. The prosthetic brassiere of claim 8 wherein the privacy panel has an inside face and an outside face, wherein portions of hook or loop material are disposed on the outside face of the privacy panel and corresponding portions of loop or hook material are disposed to interior surface sides of the first and second brassiere cups whereby the privacy panel can be retained relative to the first and second brassiere cups with a portion thereof underlying the first and second brassiere cups.

10. The prosthetic brassiere of claim 9 wherein hook material is disposed on the outside face of the privacy panel and loop material is disposed to the interior surface sides of the first and second brassiere cups whereby the hook material will generally be disposed facing away from the chest of the wearer.

11. The prosthetic brassiere of claim 1 wherein the fastening arrangement comprises a front-closure fastening arrangement comprising a plurality of hooks retained relative to the inboard side of the first brassiere cup in combination with a plurality of receiving loops retained relative to the inboard side of the second brassiere cup.

12. The prosthetic brassiere of claim 11 wherein the plurality of hooks are retained to an exterior surface side of the cup shell of the first brassiere cup and wherein the plurality of receiving loops are retained to an interior surface side of the cup shell of the second brassiere cup.

13. The prosthetic brassiere of claim 11 further comprising a flap retained relative to an exterior surface side of the cup shell of the second brassiere cup for overlying and concealing the plurality of hooks and the plurality of receiving loops.

14. A prosthetic brassiere for retaining at least one breast prosthesis relative to a chest of a wearer, the prosthetic brassiere comprising:

a first brassiere cup with an inboard side, an outboard side, and a cup shell with an exterior surface and an interior surface that defines an open inner volume;

a second brassiere cup with an inboard side, an outboard side, and a cup shell with an exterior surface and an, interior surface that defines an open inner volume;

a means for coupling the inboard side of the first brassiere cup to the inboard side of the second brassiere cup;

at least one back strap with an end coupled to the outboard side of the first brassiere cup and an end coupled to the outboard side of the second brassiere cup;

a fastening arrangement operably associated with the first brassiere cup, the second brassiere cup, and the at least one back strap for enabling the first brassiere cup, the second brassiere cup, and the at least one back strap to cooperate to form a body-encircling portion for surrounding the chest of the wearer wherein the fastening arrangement comprises a first jaw panel with an inside face and an outside face, a second jaw panel with an inside face and an outside face, and a tongue panel with a first face and a second face in combination with means for selectively engaging the inside faces of the first and second jaw panels with the first and second faces of the tongue panel wherein the fastening arrangement comprises a front-closure fastening arrangement wherein first and second jaw panels are coupled to the inboard side of the first brassiere cup and wherein the tongue panel is coupled to the inboard side of the second brassiere cup whereby the inboard sides of the first and second brassiere cups can be coupled together by interposing the tongue panel between the first and second jaw panels to cause the corresponding sections of hook and loop material to engage and whereby the first and second brassiere cups can be separated by separating the first and second jaw panels from the tongue panel; and a means for retaining a prosthetic breast relative to the open inner volume of the first brassiere cup.

15. The prosthetic brassiere of claim 14 further comprising a first shoulder strap with a first end with a means for removably and replaceably coupling to the first brassiere cup and a second end with a means for removably and replaceably coupling to the at least one back strap and a second shoulder strap with a first end with a means for removably and replaceably coupling to the second brassiere cup and a second end with a means for removably and replaceably coupling to the at least one back strap whereby the prosthetic brassiere can be worn in a strapped arrangement with the first and second shoulder straps coupled to the first and second brassiere cups and the at least one back strap and whereby the prosthetic brassiere can be worn in a strapless configuration with the first and second should straps removed.

16. The prosthetic brassiere of claim 14 further comprising a means for retaining a prosthetic breast relative to the open inner volume of the second brassiere cup wherein the cup shell of each of the first and second brassiere cups has a volume of padding thereby to ensure a consistently symmetrical appearance of the first brassiere cup relative to the second brassiere cup and wherein the first brassiere cup has an open inner volume for receiving a natural breast of a wearer.

17. A prosthetic brassiere for retaining at least one breast prosthesis relative to a chest of a wearer, the prosthetic brassiere comprising:

a first brassiere cup with an inboard side, an outboard side, and a cup shell with an exterior surface and an interior surface that defines an open inner volume;

a second brassiere cup with an inboard side, an outboard side, and a cup shell with an exterior surface and an interior surface that defines an open inner volume;

a means for coupling the inboard side of the first brassiere cup to the inboard side of the second brassiere cup;

at least one back strap with an end coupled to the outboard side of the first brassiere cup and an end coupled to the outboard side of the second brassiere cup;

a fastening arrangement operably associated with the first brassiere cut, the second brassiere cup, and the at least one back strap for enabling the first brassiere cup, the second brassiere cup, and the at least one back strap to cooperate to form a body-encircling portion for surrounding the chest of the wearer;

a means for retaining a prosthetic breast relative to the open inner volume of the first brassiere cup;

a first shoulder strap with a first end with a means for removably and replaceably coupling to the first brassiere cut and a second end with a means for removably and replaceably coupling to the at least one back strap and a second shoulder strap with a first end with a means for removably and replaceably coupling to the second brassiere cup and a second end with a means for removably and replaceably coupling to the at least one back strap whereby the prosthetic brassiere can be worn in a strapped arrangement with the first and second shoulder straps coupled to the first and second brassiere cups and the at least one back strap and whereby the prosthetic brassiere can be worn in a strapless configuration with the first and second should straps removed wherein the means for removably and replaceably coupling the first end of the first shoulder strap to the first brassiere cup includes a retaining flap with a proximal end coupled to the first brassiere cup and a free distal end and wherein the means for removably and replaceably coupling the first end of the second shoulder strap to the second brassiere cup includes a retaining flap with a proximal end coupled to the second brassiere cup and a free distal end.

18. The prosthetic brassiere of claim 17 further comprising an aperture disposed relative to each of the first and second brassiere cups adjacent to the retaining flaps wherein each aperture defines an entrance to an open inner volume whereby the retaining flaps can be passed at least partially through the apertures and tucked at least partially into the open inner volumes when the prosthetic brassiere is to be worn in a strapless configuration thereby to at least partially retain and conceal the retaining flaps.

19. The prosthetic brassiere of claim 18 wherein the apertures are disposed to an interior surface side of each cup shell.

20. The prosthetic brassiere of claim 19 wherein the means for retaining the prosthetic breast relative to the open inner volume of the first brassiere cup comprises a rear wall that cooperates with the cup shell to substantially enclose the open inner volume.

21. The prosthetic brassiere of claim 20 wherein the aperture that defines the entrance to the open inner volume of the first brassiere cup comprises an opening between the cup shell and the rear wall whereby a portion of the prosthetic breast can project at least partially through the aperture to maintain the breast prosthesis in a given orientation relative to the first brassiere cup and whereby the retaining flap can be tucked at least partially into the open inner volume overlying the projecting portion of the prosthetic breast.

22. The prosthetic brassiere of claim 20 further comprising a laterally disposed aperture between the rear wall of the first brassiere cup and the cup shell for enabling an insertion, removal, and adjustment of the prosthetic breast.

23. The prosthetic brassiere of claim 22 further comprising a unitary resilient band secured to base portions of the first and second brassiere cups.

24. The prosthetic brassiere of claim 17 further comprising a means for retaining a prosthetic breast relative to the open inner volume of the second brassiere cup.

* * * * *